United States Patent [19]

Drori

[11] 4,002,108

[45] Jan. 11, 1977

[54] VENTILATED BACK-SEAT REST PARTICULARLY FOR AUTOMOTIVE VEHICLES

[76] Inventor: Mordeki Drori, 89 Zahal St., Kiron, Israel

[22] Filed: Aug. 27, 1975

[21] Appl. No.: 608,309

Related U.S. Application Data

[63] Continuation of Ser. No. 498,634, Aug. 19, 1974, abandoned.

[52] U.S. Cl. ..... 98/2.03; 165/170; 297/453; 297/180; 5/347

[51] Int. Cl.[2] ..... A47C 7/74; B60H 1/00

[58] Field of Search ..... 98/2.03, 89; 165/46, 165/170; 62/261; 297/180, 453; 5/347

[56] References Cited

UNITED STATES PATENTS

| | | | |
|---|---|---|---|
| 1,475,912 | 11/1923 | Williams | 98/2.03 |
| 2,158,801 | 5/1939 | Petterson | 98/2.03 |
| 2,219,072 | 10/1940 | King | 165/170 |
| 2,722,266 | 11/1955 | Kersten | 98/2.03 |
| 2,782,834 | 2/1957 | Vigo | 62/261 |
| 2,791,956 | 5/1957 | Guest | 97/2.03 |
| 2,992,604 | 7/1961 | Trotman et al. | 98/2.03 |
| 3,120,406 | 2/1964 | Shelton | 297/453 |
| 3,209,380 | 10/1965 | Watsky | 5/347 |
| 3,370,520 | 2/1968 | Mauch | 98/2.03 |
| 3,550,523 | 12/1970 | Segal | 98/2.03 |
| 3,681,797 | 8/1972 | Messner | 297/180 |

*Primary Examiner*—John J. Camby
*Assistant Examiner*—Henry C. Yuen
*Attorney, Agent, or Firm*—Benjamin J. Barish

[57] ABSTRACT

A ventilated back-seat rest particularly for automotive vehicles is described comprising a panel formed with air passageways open at the side thereof contacted by the occupier of the chair or seat, and a conduit conducting air to the air passageways. The air conduit is preferably a tube leading to the vicinity of the center of the panel, and the air passageways are open channels formed according to a spiral formation starting from the center of the panel and leading to its outer edge. To enable its use in automotive vehicles, one described embodiment includes an air-funnel attachable to the exterior of the automotive vehicle and connected to the free end of the air conduit for conducting air thereto, and a second described embodiment includes a connection for connecting the free end of the air conduit to the ventilating fan of the automotive vehicle.

3 Claims, 8 Drawing Figures

VENTILATED BACK-SEAT REST PARTICULARLY FOR AUTOMOTIVE VEHICLES

This is a continuation of application Ser. No. 498,634 filed Aug. 19, 1974, now abandoned.

BACKGROUND OF THE INVENTION

The present invention relates to chairs (which expression includes seats), and particularly to an arrangement for providing a ventilated chair back rest or seat rest. The invention is especially useful for automotive vehicle seats and is therefore described below, for purposes of example, with respect to that application.

The occupier of a seat in an automotive vehicle may be subjected to considerable discomfort because of the lack of air circulation between him and the vehicle seat, particularly if the vehicle seat includes plastic covers. For that reason, a number of back rests and seat rests have been devised for spacing the occupier's back and/or seat from the automotive seat. These devices are usually of porous formation (e.g. straw) or of cellular formation (e.g. plastic), but they have not been found entirely satisfactory.

SUMMARY OF THE PRESENT INVENTION

An object of the present invention is to provide a new device for use as a back rest or seat rest which more effectively ventilates the occupier's back or seat, when compared to the above-described known devices.

According to the present invention, there is provided a body supporting device for use as a chair back rest, or seat rest comprising a spirally-corrugated panel of moulded plastic material defining undulating channels open both at the upper face of the panel to be contacted by the occupier of the chair, and at the underface of the panel. An air conduit is provided to extend along the underface of the panel from the outer periphery of the spiral to its center. One end of the air conduit is connectable to a source of air, and the opposite end is connected to an opening passing through the panel at the center of the spiral. Thus, the air is conducted to the upper face of the panel through the center of the spiral, and the open channels at the upper face of the panel, closed by the occupier, direct the air along the spiral into direct contact with occupier, the air escaping from the channels at the outer edges of the panel where not contacted by the occupier.

In one described embodiment, the underface of the corrugated panel is formed with a radial channel leading from the outer end of the sprial to the opening in its center, the air conduit being a tube disposed within the radial channel.

In another described form, the air conduit is a tube disposed within the open spiral channel at the underface of the panel to extend from the outer periphery of the spiral to the opening in its center.

While it is contemplated that the device will be primarily useful as a separate back rest and/or seat rest to be applied over the chair, the device could also be fixedly attached to the chair so as to constitute the actual back and/or seat of the chair.

Further features and advantages of the invention will be apparent from the description below.

BRIEF DESCRIPTION OF THE DRAWING

The invention is herein described, by way of example only, with reference to the accompanying drawings, wherein.

FIGS . 5–7 illustrate various means for supplying air to the device particularly when the device is used with respect to seats for automotive vehicles.

DESCRIPTION OF SEVERAL PREFERRED EMBODIMENTS

Figure 1:
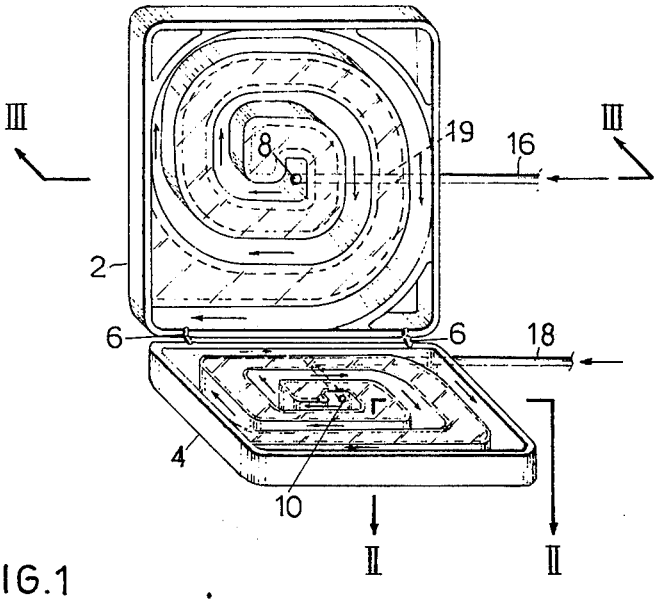
FIG. 1 illustrates both a back rest and a seat rest constructed in accordance with the invention, the channel dimensions being somewhat exaggerated to better show its structure (a more practical dimensional relationship being shown in FIG. 8)
Figure 2:
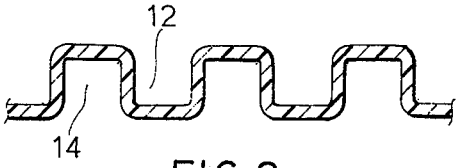
FIG. 2 is a fragmentary enlarged sectional view along lines II—II of FIG. 1.
Figure 3:
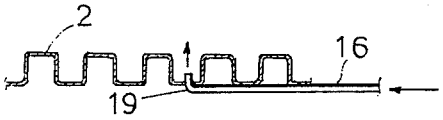
FIG. 3 is a sectional view along lines III—III of FIG. 1 illustrating the manner of accommodating the air supply tube for one panel.

The device illustrated in FIGS. 1—3 includes a panel or board 2 serving as a back rest, and a second similar panel or board 4 serving as the seat rest, the two panels being hingedly connected together along one edge by rings 6. Each panel is of moulded plastic material and is formed with a spirally-extending undulating channel starting from the center 8, 10 of the respective panel and leading to its outer edge. The channels of both panels are of U-section, particularly shown in FIG. 2, and are open on the opposite sides or faces shown at 12, 14, respectively.

A tube 16, 18 extends along the under-side of each panel 2, 4, and is connected to the center starting points 8, 10 of their spirally-extending channels. Tubes 16, 18 conduct air to the two channels, the air circulating along the channels and exiting from the portions of the open side 12 of the panels not covered by the occupier.

It will thus be seen that when the chair is occupied, the air circulates through the upwardly-opening channels 12 (FIG. 2) and comes into direct contact with the back of the occupier leaning against panel 2, and with the seat of the ocupier sitting on panel 4.

The air is directed by tubes 16, 18 to the centers of the respective channels, to move from the centers in the outward direction. This is because it is more likely that the centers of the panels will be covered by the occupier and therefore the air within the channels will be contained therein for longer contact with the chair occupier. This is in contrast to an arrangement wherein the air circulation is started at the outer edges of the panels which would cause most of the air to escape before coming into contact with the chair occupier.

It is thus seen that the air passages for conducting the air from the center of each panel are constituted by the channels formed in the panel together with the body of the occupier which closes the upper side or face 12 of the panel when occupying the chair. Accordingly, the air comes into direct contact with the body of the occupier as the air moves along these so-formed air passages. No outlet need be formed for these air passages because the air will exit from the open side 12 wherever not covered by the occupant, as it is highly unlikely that side 12 of the panel will ever be completely covered by the occupant. Accordingly, a continuous circulation of the air is formed with the air coming into direct contact with the body of the occupier contacting the open side 12 of the panel.

Figure 4:
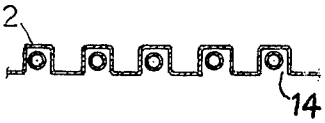
FIG. 4 is a corresponding sectional view illustrating the manner of accommodating the air supply tube for the other panel.

The air supply tube 16 is accommodated in a radial channel 19 formed in the under-side of panel 2 starting from the outer edge and extending inwardly, as shown in FIGS. 1 and 3. FIG. 4 illustrates another manner of accommodating the air supply tubes, tube 18 in this case being disposed in the downwardly-open channels 14 of panel 4 and extending spirally within the channels from the outer edge to the center air intlet 10. It will be appreciated that the same arrangement could be used for accommodating the air supply tubes for both panels.

Figure 5:
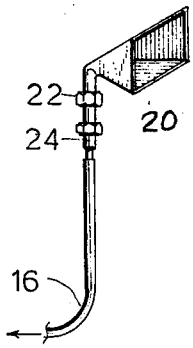

Air may be supplied to the tubes 16, 18 in a number of ways. FIG. 5 illustrates one arrangement, wherein an air-funnel 20 is fixed to the exterior of the automotive vehicle by brackets 22. For example, funnel 20 may be carried at the upper end of a hollow support 24 adapted to pass through an opening in the automobile fender and fixed thereto by brackets 22, the lower end of hollow support 24 receiving the end of air supply tube 16.

Figure 6:
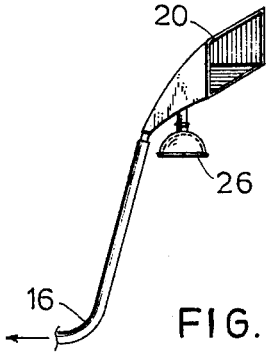

FIG. 6 illustrates a similar arrangement but including an externally-mounted air funnel 20, in this case the air funnel being removably attached to the vehicle by a suction-cup 26.

Figure 7:
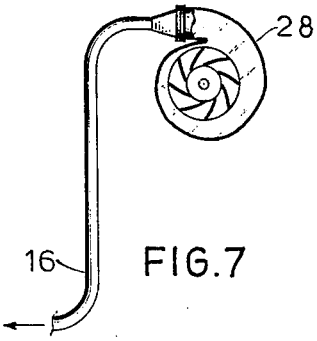

FIG. 7 illustrates a still further arrangement, wherein the free end of the air tube 16 is connected to the ventilating fan, schematically shown at 28, of the automotive vehicle.

Figure 8:
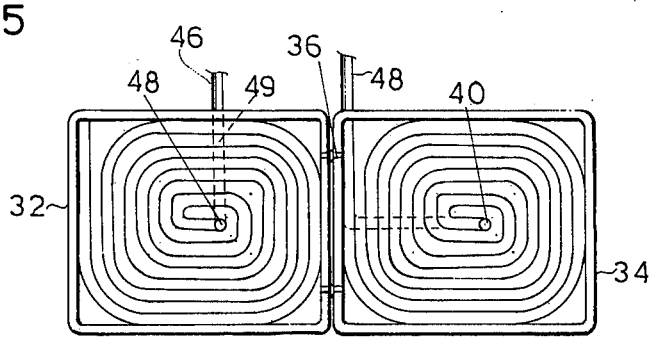
FIG. 8 is a top plan view of a practical construction of a back and seat rest in accordance with the invention.

FIG. 8 is a top plan view of a back rest and seat rest (in the open condition) of substantially the same construction as illustrated in FIGS. 1–3, but wherein the air passageways are of smaller dimensions and more closely spaced, which would normally be more practical particularly where the device is used in automotive vehicles. Thus, the device in FIG. 8 includes a back rest panel 32 and seat rest panel 34 hingedly attached to each other by rings 36. As in the case of the device of FIGS. 1–3, air tube 46 communicating with the center 48 of panel 32 is accommodated in a radial channel 49; and air tube 48 communicating with the center 40 of panel 34 is accommodated within the spiral channel itself.

It will be appreciated that the arrangement for accommodating the air tubes illustrated in the FIG. 8 embodiment, as well as in the FIGS. 1–3 embodiment, is merely for purposes of example, and that the air tubes in both panels could be accommodated in the same manner, e.g. both in radial channels or in the spirally-extending channels.

While the drawings illustrate the back rest and seat rest as being in the form of separate panels to be applied over the chair or seat, it will be appreciated that these panels could be built-in as an integral part of the chair or seat to constitute the back and/or seat of the chair or seat itself.

Further variations, modifications, and applications of the illustrated embodiments will be apparent.

What is claimed is:

1. A body supporting device for use as a chair back rest or seat rest, comprising: a panel of molded plastic material formed with a spirally-extending corrugation defining a spiral channel open at the upper face of the panel and a spiral channel open at the under face of the panel; and an air conduit extending along the under face of the panel from the outer periphery of its spiral channel to the center thereof; one end of the conduit being connected to a source of air, and the opposite end of the conduit being connected to an opening passing through the panel at the center of the spiral channels to conduct the air to the upper face of the panel; whereby, when the device is occupied by an occupier contacting the center of the upper face of the panel, the center of the open spiral channel at the upper face of the panel is covered by the occupier and the air is directed along the upper face spiral channel in direct contact with the occupier and escapes from the channel at the outer edges of the panel where not contacted by the occupier.

2. A device according to claim 1, wherein the under face of the corrugated panel is formed with a radial channel leading from the outer periphery of the spiral to the opening in the center thereof, the air conduit being a tube disposed within said radial channel.

3. A device according to claim 1, wherein the air conduit is a tube disposed within the open spirally-extending channel at the under face of the panel to extend from the outer periphery of the spiral to the opening in the center thereof.

* * * * *